US005881708A

United States Patent [19]

Kliot

[11] Patent Number: 5,881,708

[45] **Date of Patent: *Mar. 16, 1999**

[54] BACKPACK FOR HEAVY BULKY FOOTWEAR

[75] Inventor: Eugene M. Kliot, New York, N.Y.

[73] Assignee: Visual Impact Films Corporation, New York, N.Y.

[ * ] Notice: The term of this patent shall not extend beyond the expiration date of Pat. No. 5,509,589.

[21] Appl. No.: 896,940

[22] Filed: Jul. 18, 1997

Related U.S. Application Data

[63] Continuation-in-part of Ser. No. 500,515, Jul. 11, 1995, Pat. No. 5,651,486, which is a continuation-in-part of Ser. No. 255,669, Jun. 9, 1994, Pat. No. 5,509,589.

[51] Int. Cl.[6] ..... A45F 3/04

[52] U.S. Cl. ..... 224/653; 224/652; 224/582; 224/917

[58] Field of Search ..... 224/653, 652, 224/650, 681, 682, 683, 684, 917, 581, 582

[56] References Cited

U.S. PATENT DOCUMENTS

| | | | |
|---|---|---|---|
| D. 312,726 | 12/1990 | Kline | D3/217 |
| D. 339,225 | 9/1993 | Zel . | |
| D. 367,173 | 2/1996 | Tribus . | |
| D. 369,021 | 4/1996 | Kliot | D3/217 |
| D. 380,294 | 7/1997 | Kliot | D3/217 |
| 2,672,263 | 3/1954 | Alber . | |
| 3,221,959 | 12/1965 | Southwick | 224/652 X |
| 3,321,120 | 5/1967 | Cunningham . | |
| 3,327,924 | 6/1967 | Brutting . | |
| 4,018,369 | 4/1977 | Jaeger | 224/582 |
| 4,096,978 | 6/1978 | Noice . | |
| 4,126,256 | 11/1978 | McArthur | 224/609 X |
| 4,746,159 | 5/1988 | Webb et al. | 224/917 |
| 4,883,207 | 11/1989 | McArthur . | |
| 4,982,883 | 1/1991 | Ullal | 224/651 |
| 5,158,220 | 10/1992 | Glass | 224/657 |

FOREIGN PATENT DOCUMENTS

| | | |
|---|---|---|
| 3323763 | 1/1985 | Germany . |

*Primary Examiner*—Renee S. Luebke
*Attorney, Agent, or Firm*—Hughes Hubbard & Reed LLP; Ronald Abramson; Peter A. Sullivan

[57] ABSTRACT

A backpack for carrying bulky, heavy footwear such as inline skates, conventional roller skates, ice skates or ski boots is provided. Preferably, a backpack for carrying inline skates is provided. According to the invention, the backpack includes a left and right opposed footwear compartments. The left and right compartments are angularly joined together at the front base portion of the compartments to form an isosceles triangle there between. The joined right and left compartments define a portion of the front face of the backpack. The compartments have a sufficient height for receipt of the blade portion of a skate and/or of the top portion of a bulky boot, for example, a ski boot. In addition, the compartments have a sufficient depth to receive the blade portion of a skate. In one improvement, the footwear compartments are L-shaped and nested such that the ankle-receiving portion of one compartment is situated above the ankle receiving portion of the other compartment. In another improvement, the interior isosceles triangular shaped space is left completely or partially open at the top and/or bottom so as to accommodate long articles such as skis, a snowboard, an umbrella, etc.. In a third improvement, the footwear compartments are collapsible, and fold up into two opposed vertical side compartments. The backpack may be designed so the footwear compartments are detachably secured together, either so as to fully contact each other, or with a gap that is bridged and made secure by suitable closures, spacers, etc.

5 Claims, 10 Drawing Sheets

38
40
22
10
22
3
32
38
34
44
40
14
12
14
3
30
16
12

BACKPACK FOR HEAVY BULKY FOOTWEAR

This application is a continuation-in-part of application Ser. No. 08/500,515 filed Jul. 11, 1995 and now U.S. Pat No. 5,651,486, which is a continuation-in-part of application Ser. No. 08/255,669 filed Jun. 9, 1994, now U.S. Pat. No. 5,509,589, and is related to U.S. Des. Pat. Nos. 369,021 and 380,294.

BACKGROUND OF THE INVENTION

1. Field of the Invention

The field of the invention is backpacks for carrying heavy footwear such as in-line skates or ski boots.

2. Description of the Prior Art

There are numerous backpacks on the market. These backpacks may be used to carry sporting equipment and the like. However, heavy bulky footwear, such as inline roller skates, conventional roller skates, ice skates, and ski boots are particularly difficult to accommodate in a standard backpack. The footwear either does not fit or shifts around in the bag. As a result, prior art backpacks have proved unsatisfactory for transporting heavy, bulky footwear.

Carriers for ice skates and roller skates and the like are known, for example, U.S. Pat. No. 4,126,256 and 2,672,263 show the use of L-shaped compartments for carrying roller skates or ice skates. Ski boot bags having a triangular shape are known. See Design U.S. Pat. No. 312,726. Backpacks having side compartments are also known in the art. See, U.S. Pat. No. 4,096,978 (Noice). However, there still is a need for a versatile backpack that can accommodate inline roller skates or other bulky footwear.

SUMMARY OF THE INVENTION

A backpack for carrying bulky, heavy footwear such as inline skates, conventional roller skates, ice skates, ski boots or riding boots is provided. Preferably a backpack for carrying inline roller skates is provided.

It is an object of the invention to provide a backpack for bulky, heavy footwear which can be comfortably carried.

It is an object of the invention to provide a backpack for bulky, heavy footwear which will evenly distribute the weight of the footwear across the back of the user.

It is an object of the invention to provide a backpack for comfortably carrying a pair of inline roller skates and a helmet.

It is an object of the invention to provide a backpack for blade skates which directs the blades away from the back of the user while distributing the weight of the load across the user's back.

It is an object of the invention to provide a compact backpack for carrying blade skates which will prevent the skates from shifting in the backpack.

Other and further objects will become apparent from the present specification.

A backpack that accomplishes the foregoing objectives is constructed in accordance with the following. The backpack includes left and right opposed footwear compartments. These compartments have a generally polygonal side face, preferably a trapezoidal or pentagonal side face, a generally rectangular back face and a narrow width. The left and right footwear compartments are angularly joined together at the front base portion of the compartments to form an isosceles triangle there between. The joined right and left footwear compartments define a portion of the front face of the backpack. A piece of luggage material such as tight weave nylon is used to complete the front of the backpack by closing off the top of the area between the left and right footwear compartments. The left and right footwear compartments are rather narrow on the front face and in fact are only wide enough to receive the narrow part of a boot or skate. This prevents shifting of the footwear when carried. The narrow width of the footwear compartments contributes to the efficient use of the space and limits the bulk of the bag. The compartments have a sufficient height for receipt of the blade portion of a skate and/or the top portion of a bulky boot, for example, a ski boot. In addition, the compartments have a sufficient depth to receive the blade portion of a skate. As a result the compartments can efficiently accommodate bulky footwear such as boots for example, ski boots and riding boots or skates for example, inline skates, ice skates or conventional roller skates with a minimal amount of wasted space.

In an alternative embodiment, the opposed footwear compartments are L-shaped and nested such that the ankle-receiving portion of one compartment is situated above the ankle receiving portion of the other compartment. In another alternate embodiment, the interior isosceles triangular shaped space is left completely or partially open at the top and/or bottom so as to accommodate long articles such as skis, a snowboard, an umbrella, etc.

In a further alternative embodiment, the opposed footwear compartments are collapsible, and fold up into to opposed vertical side compartments. The backpack may be designed so the footwear compartments are detachably secured together, either so as to fully contact each other, or with a gap that is bridged and made secure by suitable closures, spacers, etc.

The backpack has been ergonomically designed to transport heavy footwear preferably boots or skates in a compact backpack which is easy and comfortable to carry. The angularly connected footwear compartments enclose the boot or skate in a minimum amount of space while at the same time directing the weight of the footwear toward the side to evenly distribute the weight across the back of the user. In addition, according to the invention when the backpack is used with blade skates, the blade portion of a skate is directed away from the user to prevent accidental injury if the user is pushed or jarred from behind. An interior compartment is also provided for carrying sport accessories.

The preferred embodiment of the present invention is illustrated in the drawings and examples. However, it should be expressly understood that the present invention should not be limited solely to the illustrated embodiments.

DETAILED DESCRIPTION OF THE PREFERRED EMBODIMENTS

According to the invention a backpack carrying bulky footwear is provided. The backpack provides a means to carry heavy footwear such as ski boots, riding boots, blade skates such as inline roller skates and ice skates, conventional roller skates, and the like in a compact package. Most preferably a backpack for carrying inline roller skates is provided. The backpack according to the invention can be easily and comfortably carried by the user without having the blades of blade skates uncomfortably and dangerously stick into the user's back and without the footwear shifting around in the backpack.

According to the invention, two opposed footwear compartments are provided. The footwear compartments have a narrow width to snugly engage the footwear, e.g., inline skates, and prevent shifting and/or movement of the footwear when carried. The footwear compartments are angularly joined at their front base to form the front of the bag and to direct the weight in the compartments outwardly toward the sides of the user. As a result, a compact backpack for transporting bulky footwear which occupies a limited amount of space is provided. The weight of the footwear carried in the backpack is evenly distributed across the back of the user. In another aspect of the invention, an interior compartment is provided between the opposed footwear compartments for carrying sports accessories such as sports helmets and pads or cold weather gear such as hats, goggles, scarves and gloves.

Figure 1:
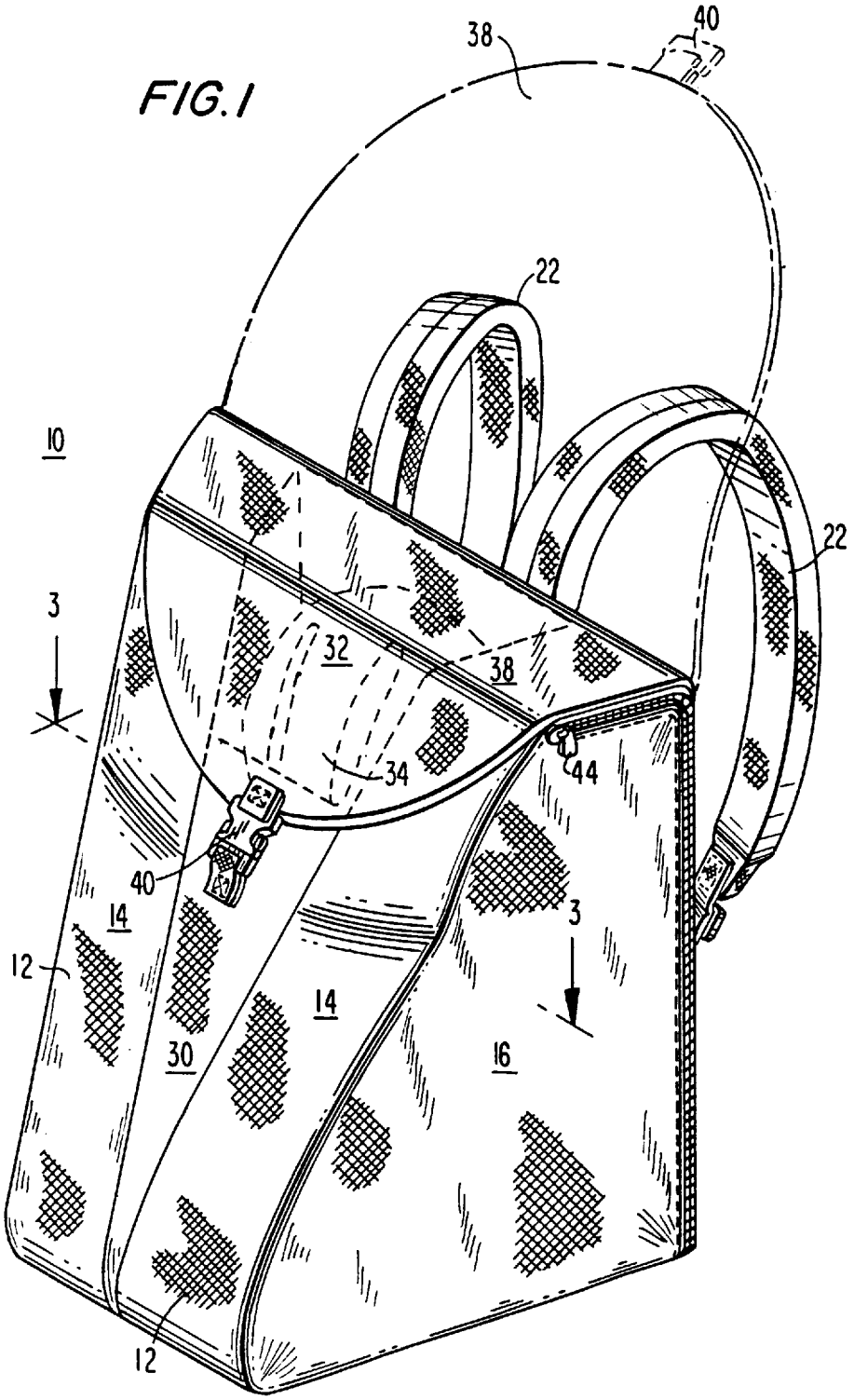
FIG. 1 is a perspective view of the backpack according to the invention.
Figure 2:
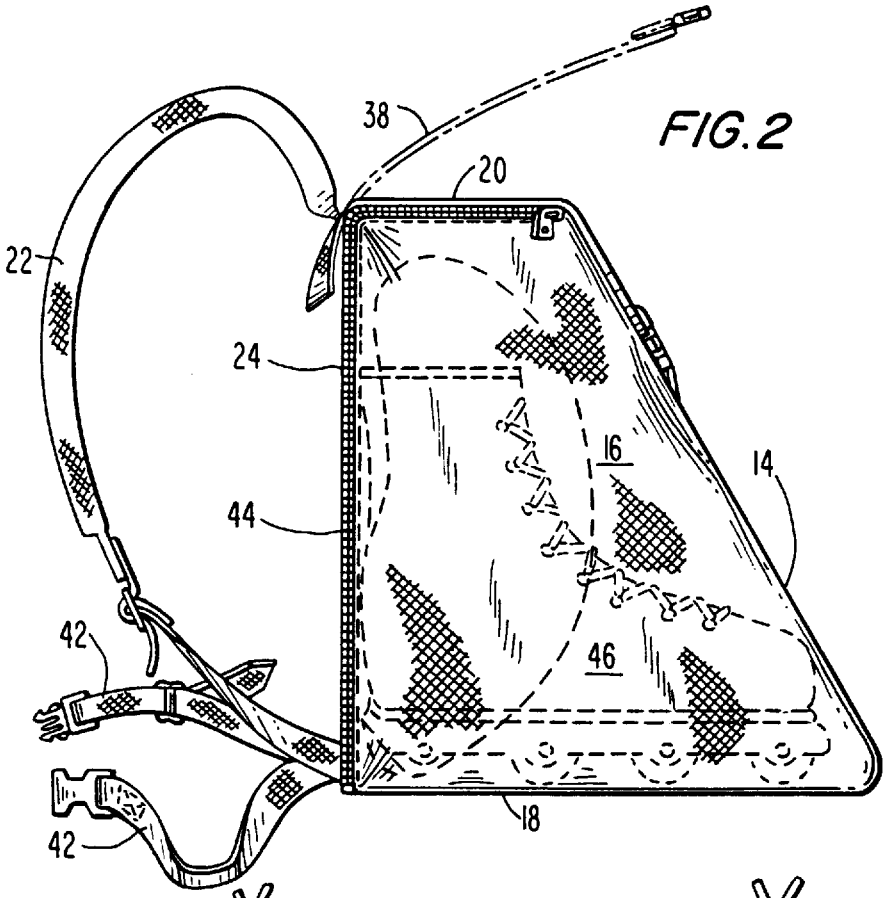
FIG. 2 is a side view of the backpack of FIG. 1 with an inline skate in place.
Figure 5:
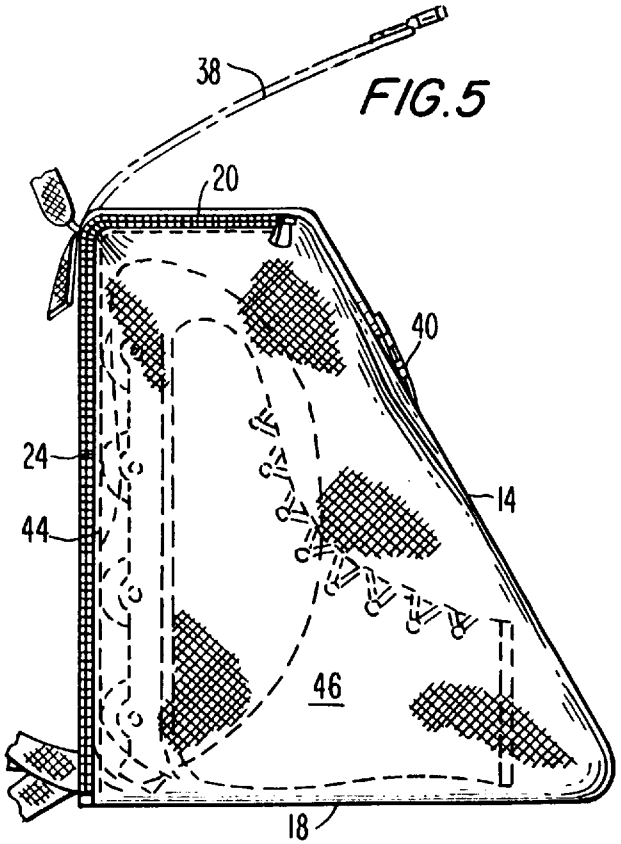
FIG. 5 is a side view of the backpack of FIG. 1 with an inline skate in an alternate location to that shown in FIG. 2.
Figure 4:
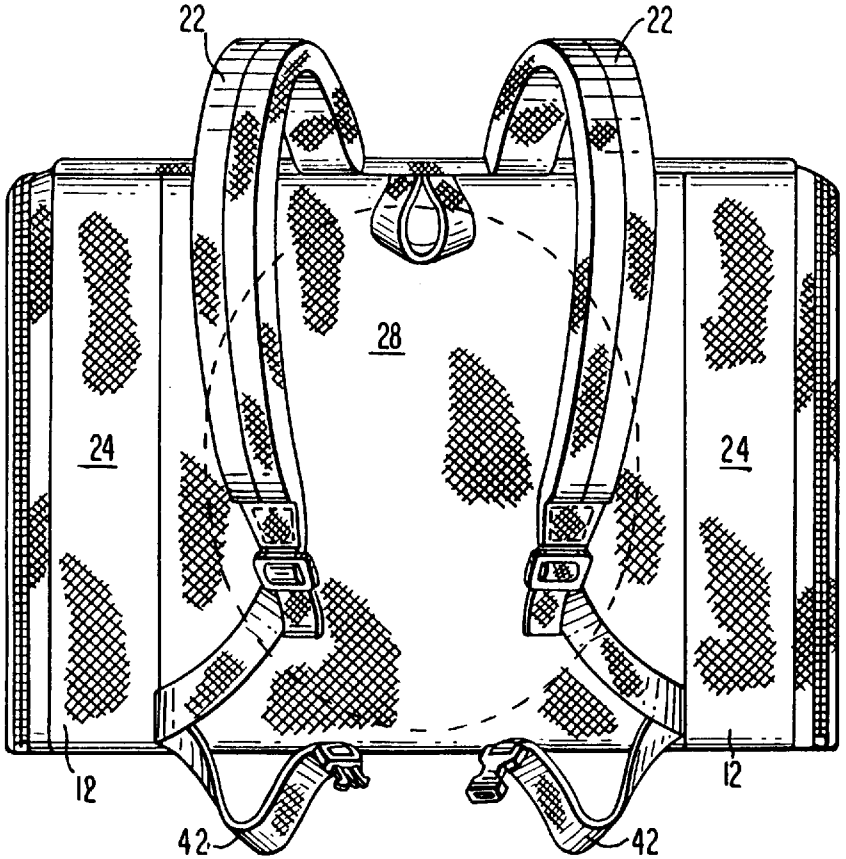
FIG. 4 is a rear view of the backpack according to the invention.
Figure 6:
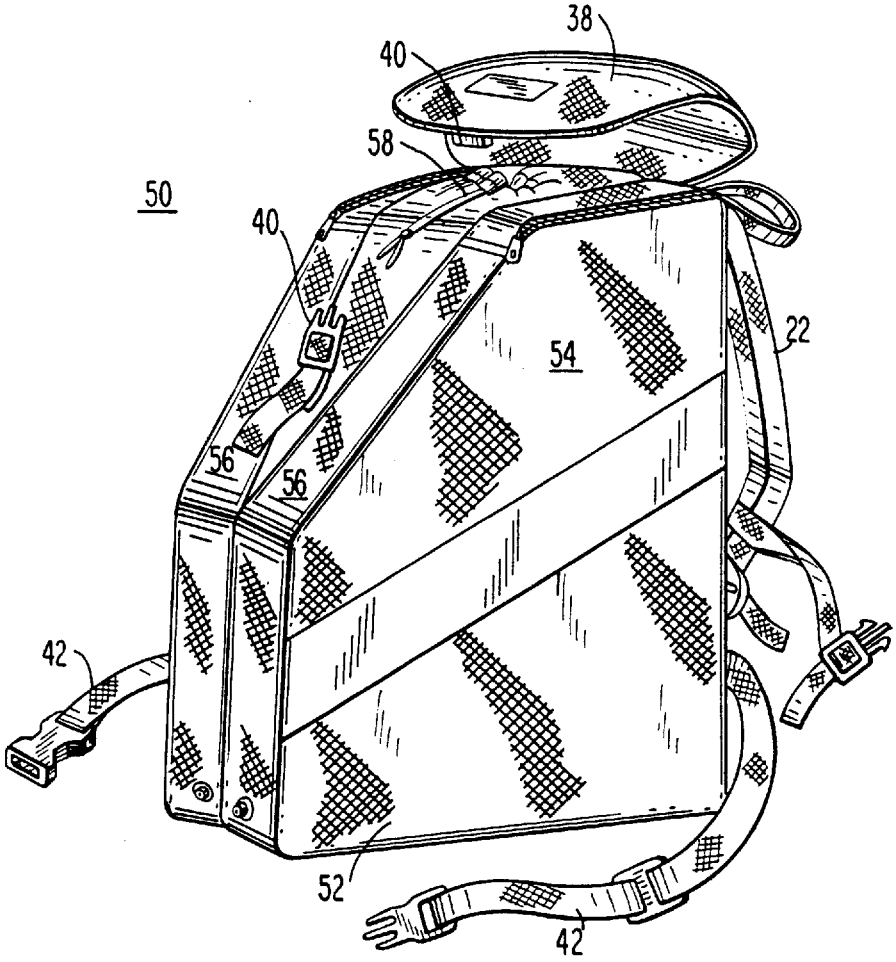
FIG. 6 is a perspective view of an alternate embodiment of the backpack according to the invention.
Figure 7:
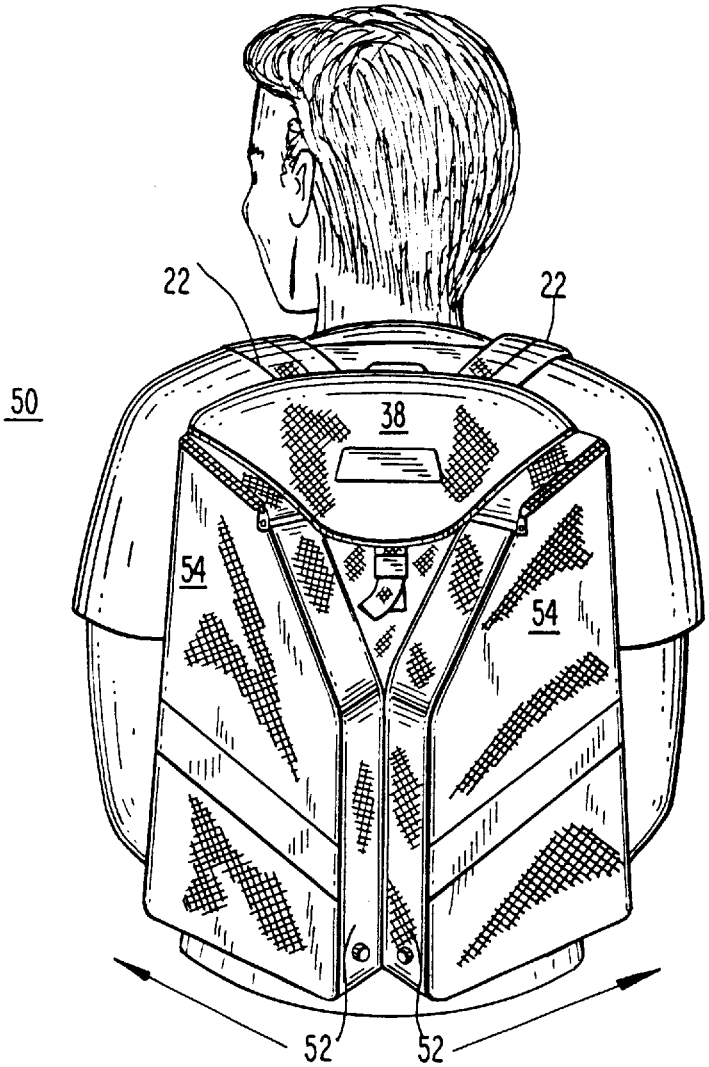
FIG. 7 is a perspective view looking from the front of FIG. 6.

Referring to FIGS. 1 to 5, according to the invention a backpack 10 is provided for carrying heavy bulky footwear. The backpack includes opposed footwear compartments 12. Compartments 12 are composed of polygonal side walls preferably trapezoidal walls 16 which are separated by back wall 24. Alternatively side walls 16 may desirably be pentagonally shaped as shown in FIGS. 6 and 7. The space between side walls 16 is narrow and is only sufficiently wide to accommodate the heel portion of the bulky footwear. Narrow front walls 14 are preferably approximately the width of a normal blade skate or ski boot. Desirably front walls 14 are about the width of the body of a normal skate or boot and may even be slightly less to obtain a snug fit. Optionally the width may be up to two times the width of the normal boot or skate. Side walls 16 are identical on either side of the footwear compartments 12. Referring to FIGS. 2 and 5, side walls 16 are desirably longer at the bottom than at the top. Preferably the top 20 of side wall 16 is from one half to two thirds the size of bottom 18 of side wall 16. Front wall 14 is sloped and interconnects the side walls 16. Vertical back wall 24 is perpendicular to side walls 16 and interconnects side walls 16 at the back.

Figure 3:
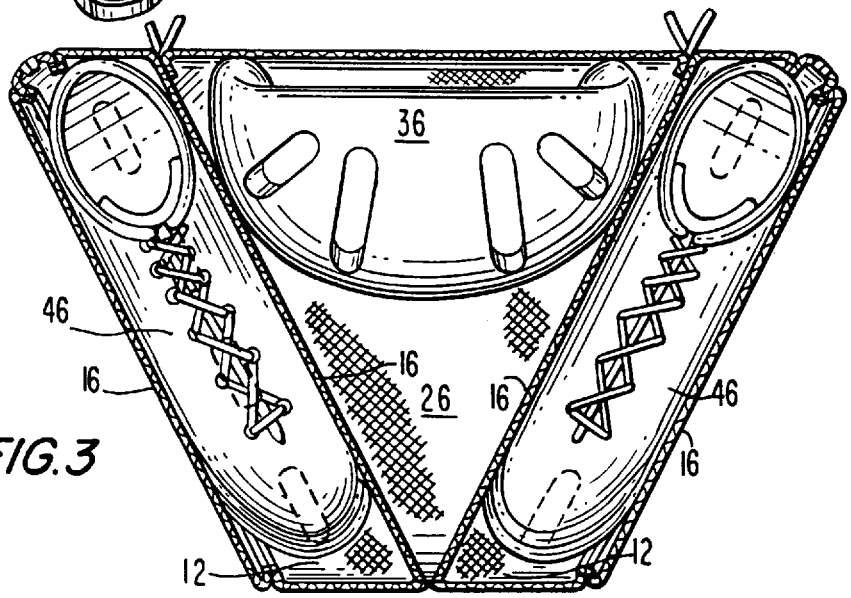
FIG. 3 is a section view through 3—3 of FIG. 1.

The backpack 10 is formed by connecting opposed footwear compartments 12 to form the left and right side of the backpack 10. The footwear compartments 12 are angularly joined together at the front base thereof preferably by sewing the compartments 12 to form a compartment therebetween preferably in the shape of an isosceles triangle. Desirably the triangle formed therebetween is an equilateral triangle. The angle $\propto$ formed between the angularly joined footwear compartments 12 is from 30° to 90° preferably from 45° to 75° and most preferably about 60°. When the angle $\propto$ is 60°, an equilateral triangle is formed between the angled footwear compartments 12. As best seen in FIG. 1 and FIG. 3, the interior compartment 34 is formed between the angularly joined footwear compartments 12 and triangular floor 26 which is sewn or otherwise attached to the bottom of footwear compartments 12. Backpack back wall 28 interconnects the rear of the angularly spaced footwear compartments 12 to complete the rear of backpack 10. Shoulder straps 22 are attached to the backpack back wall 28 for carrying the backpack 10. The front of the bag is completed by front wall extension 30 which is sewn to the front 14 of footwear compartments 12 to close off the interior compartment 34 from the outside. The interior compartment 34 has an opening 32 at the top to allow loading of the athletic accessories. Preferably the interior compartment is generally triangular and is of sufficient size so that a sporting helmet 36 can be carried in the interior compartment 34. Optionally other sporting equipment can be carried either in conjunction with the helmet 36 or instead of the helmet. For example, when the bag 10 is used for inline roller skating, knee, wrist and elbow pads can be carried. Optionally if the bag 10 is used for ski boots, winter wear accessories can be carried in the compartment 34 for example, gloves scarves and hats. A cover 38 is hingedly attached to the top of backpack 10 to close off opening 32. Preferably the cover 38 is held in place through interlocking connector 40. Optionally a VELCRO™ hook and loop connector system can be used. Desirably a lumbar belt support system 42 is provided so that the bag 10 can be secure around the user's waist. Footwear compartments 12 include zipper closure system 44 which allow opening of compartment 12 along the top 20 and the vertical back wall 24, however, other closure mechanisms are contemplated such as straps or VELCRO™ load frame bag closures. The backpack can be made out of a variety of materials that are suitable for soft-sided luggage. Preferably the backpack is made out of heavy tight weave nylon most preferably, nylon cordura or nylon pack cloth.

Referring now to FIGS. 6 and 7 which show an alternative embodiment of the backpack according the invention. The same parts as shown in FIGS. 1 through 5 are referred to by the same reference numerals. The backpack 50 of FIGS. 6 and 7 has polygonal footwear compartments, preferably pentazoidal shaped footwear compartments 52 having pentazoidal shaped side walls 54 and sloping front walls 56. As shown in FIG. 6 the footwear compartments are sewn together a greater distance at the front base thereof than the embodiment of Figures. 1 through 5. As shown in FIG. 7, in use the weight of the footwear is directed as shown by the arrows. As shown in FIG. 6 optionally a drawstring closure 58 is provided to close off the interior compartment of the bag.

In use, one each of a pair of heavy footwear preferably an inline skate 46 is placed in each of the footwear compartments 12. There are two preferred configurations for the skates. As shown in FIG. 2, the skate can be placed in the compartment so that the blade extends horizontally along the side of the bag 10. In this configuration the blade of the skate 46 will be directed away from the back of the user and hence, any jarring during carrying of the bag will not result in any discomfort or injury due to the blade imbedding in the user's back. Optionally as shown in FIG. 5 the blade skate 46 may be inserted into the bag so that the blade extends vertically toward the back of the bag 10. In such an embodiment the ankle portion of the skate 46 will point toward the front of the bag. Again the blade of the skate will be directed away from the back of the user by the angularly joined footwear compartments 12. In the case of blade skates, carrying the blade, which often digs into the user's back in a normal backpack, is directed by the angled footwear compartments away from the back of the user. When ski boots are used, it is generally preferred that the sole portion of the boot be placed in the horizontal direction in the footwear compartments 12 and the boot portion extend in the vertical direction and rest against the back of the angularly joined footwear compartments. Since the side walls 16 are narrowly spaced apart, the boot or skate is held securely in the compartment without shifting. The resulting backpack is compact and can be used to easily transport heavy footwear preferably inline roller skates, conventional roller skates, ice skates, ski boots and riding boots most preferably inline roller skates. The weight of the bag is evenly and uniformly distributed across the back of the user. The symmetrically aligned angularly connected footwear compartments point any skate blade away from the back of the user and thus minimize the likelihood of injury or discomfort due to the lodging of the blade into the back of the user. Moreover, the arrangement minimizes the space required to carry the skates or other footwear and allows for a roomy inside compartment which can be used to carry other sporting equipment which will usually be associated with the heavy footwear.

Figure 8:
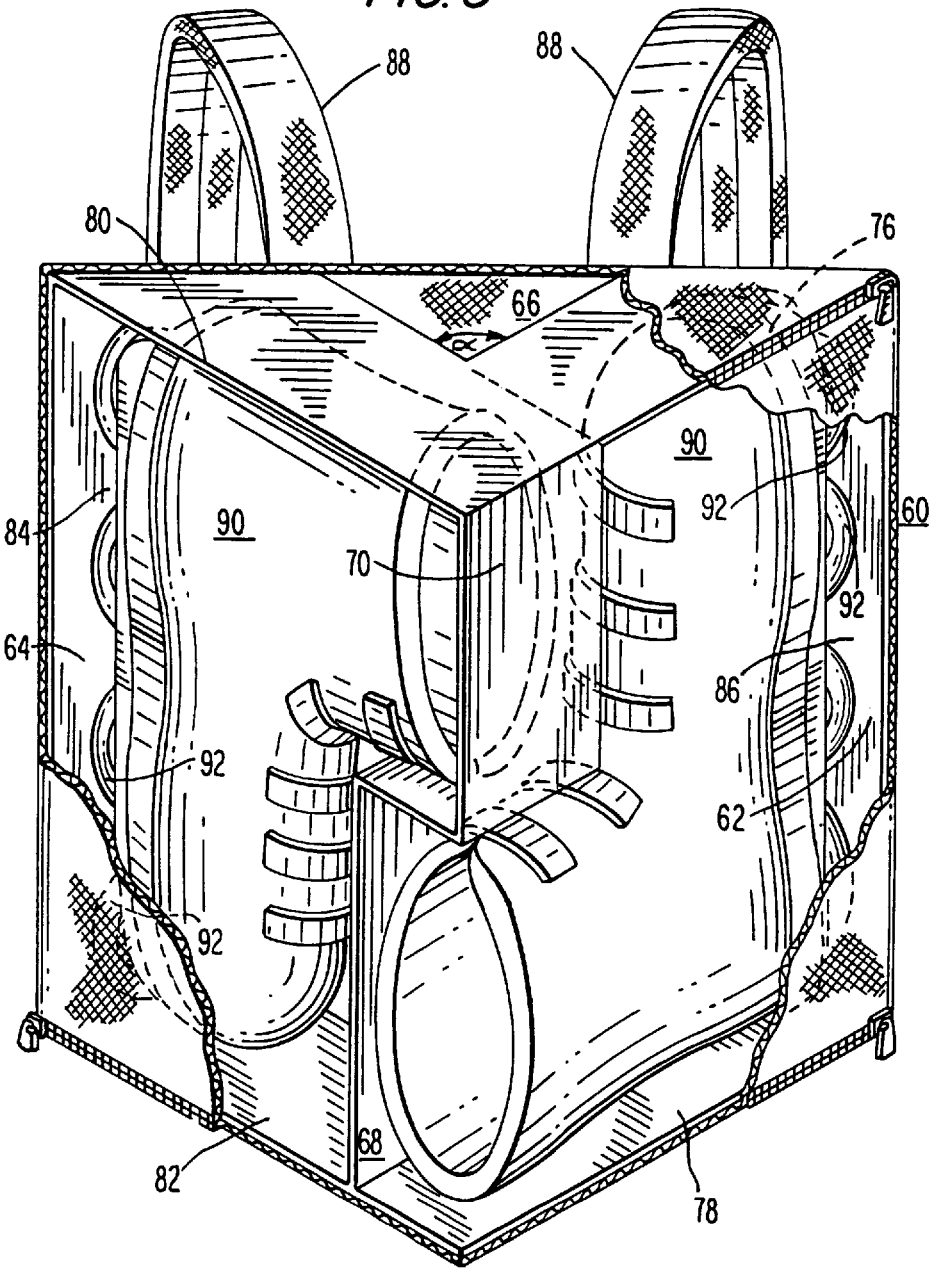
FIG. 8 is a perspective view of an alternate embodiment of the backpack according to the invention.

In another embodiment of the invention, nested footwear compartments are provided. As best seen in FIG. 8, a backpack 60 having nested footwear compartments 62 and 64 is provided. According to the invention, first footwear compartment 62 and second footwear compartment 64, are adapted to receive heavy bulky footwear such as in-line skates, ice skates, ski boots or the like. The back walls 84 and 86 of footwear compartments 64 and 62 have a sufficient height to receive the sole of a heavy bulky footwear. As shown in FIG. 8, the compartments 62 and 64 have a sufficient height to receive the long blade portion 92 of a blade skate 90 along the back walls 84 and 86 of footwear compartments 62 and 64. Alternatively, compartments 62 and 64 are sized to receive the sole portion of the ski boot or of other heavy bulky footwear. Compartment 62 has bottom wall 78 having a length which is longer than the length of the top wall 76. Preferably, the length of bottom wall 78 is twice the length of top wall 76. As a result, L-shaped footwear compartment 62 is formed. The bottom of compartment 62 is sized to receive the ankle portion of a heavy bulky footwear, such as the ankle portion of a blade skate 90 as shown in FIG. 8 or alternatively the ankle portion of the ski boot or other heavy bulky footwear. As a result, the bottom portion of compartment 62 forms ankle receiving compartment 68, which comprises one leg of L-shaped compartment 62.

A second footwear compartment 64 is provided. Footwear compartment 64 has top wall 80 which is longer than bottom wall 82 of compartment 64. Preferably, top wall 80 is twice as long as bottom wall 82. Similar to compartment 62, an L-shaped compartment 64 is formed. However, compartment 64 is longer at the top than at the bottom. A second ankle receiving compartment 70 is formed at the top of compartment 64. The compartments 62 and 64 are angularly joined together at the front thereof to form the front of the backpack 60. The ankle receiving compartments 68 and 70 are nested together in the front, that is, compartment 68 forms the front bottom of the backpack. Compartment 70 nests on the top of compartment 68 and forms the top front of the backpack 60. Preferably, compartment 68 is sewn to compartment 64 and to compartment 70. Preferably, compartment 70 is sewn to compartment 62. As a result, a compact backpack is formed.

Similar to the embodiments of FIGS. 1 through 7, the footwear compartments 62 and 64 form an interior compartment 66 there between preferably in the shape of an isosceles triangle. Desirably the triangle formed there between is an equilateral triangle. The angle $\alpha$ formed between the angularly joined footwear compartments 62 and 64 is from 30° to 90° preferably from 45° to 75° and most preferably about 60°. When the angle $\alpha$ is 60°, an equilateral triangle is formed between the angled footwear compartments 62 and 64. The interior compartment 66 is formed between the angularly joined footwear compartments 62 and 64 and a triangular floor is sewn or otherwise attached to the bottom of footwear compartments 62 and 64.

Desirably, the triangularly shaped central compartment 66 is a sufficient size for receipt of miscellaneous gear which may be associated with the heavy bulky footwear. Optionally, the area 66 may be sized sufficient to receive a roller skating helmet. Optionally, space 66 may be smaller and only sized to sufficiently to receive pads or other miscellaneous items such as gloves or ski equipment. Optionally, a belt or strap can be provided on the front of the bag to hold a helmet. Shoulder straps 88 are attached to the back of the bag. Optionally, a cover can be provided to close off the triangular interior compartment as shown in FIGS. 1 to 7.

Figure 9:
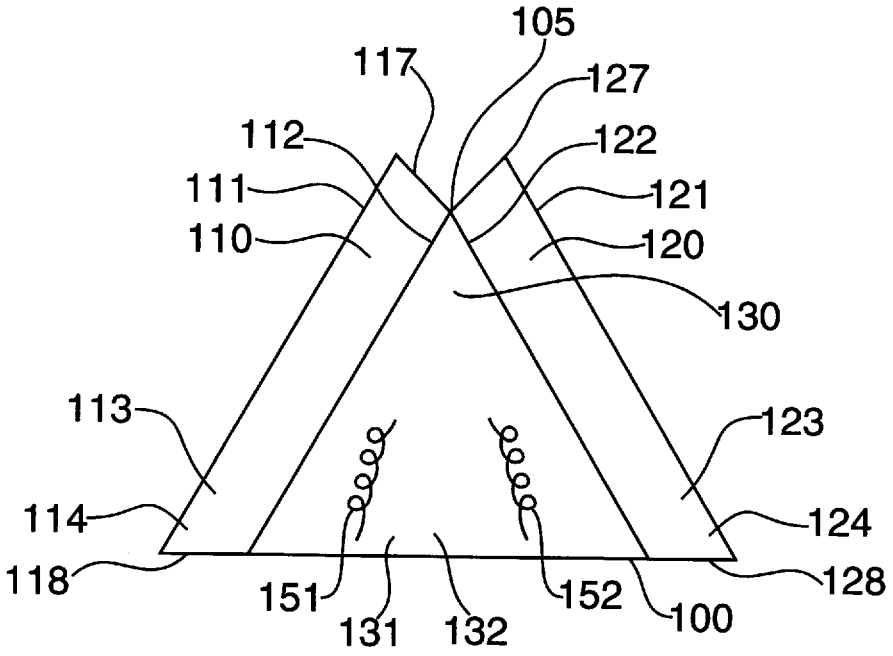
FIGS. 9 and 10 are sectional views of two additional alternative embodiments of the backpack, showing an interior isosceles triangular shaped compartment that is completely or partially open at the top and/or bottom.
Figure 10:
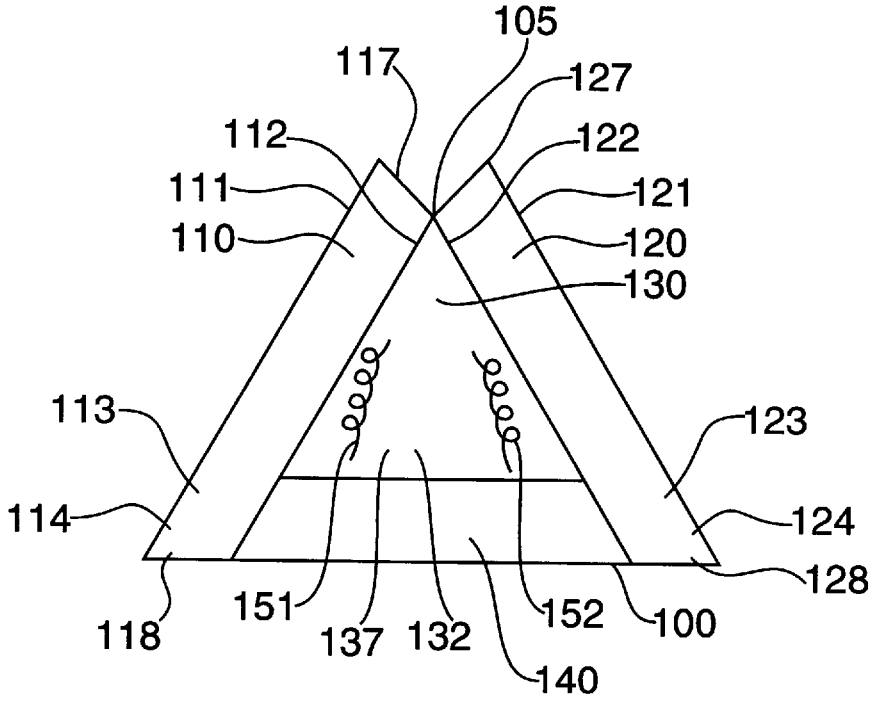

A further embodiment of the invention is shown, in two variations, in FIGS. 9 and 10. These embodiments are generally the same as those shown in FIGS. 1–5 or 6–7, except that all or part of the top 131 and bottom 132 of the generally isosceles shaped interior compartment 130 enclosed by the footwear compartments 110, 120 is left open so as to enable the user to carry lengthy articles, such as skis, a snowboard, an umbrella, etc., the length of which would not fit in a closed compartment. Suitable attachment means such as cords, hooks, VELCRO™ hook and loop fasteners, 151, 152 may be provided within the interior compartment in order to secure the lengthy article to the backpack. FIG. 9 shows such a backpack with the top and bottom of the interior compartment completely open, and FIG. 10 shows a variation with a subcompartment 140 partially occupying the interior compartment 130.

Figure 11:
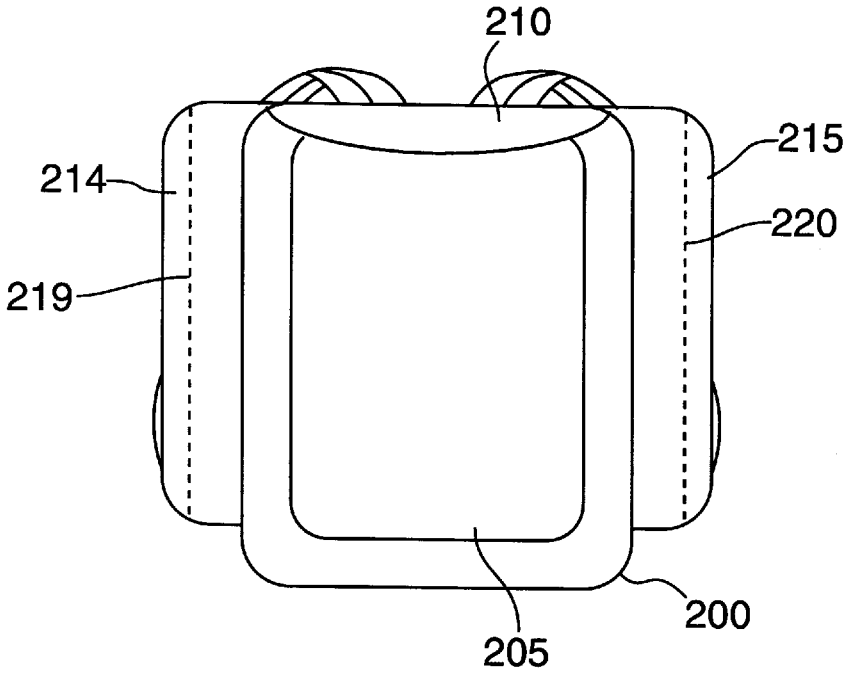
FIGS. 11 and 12 are perspective views of a further alternate embodiment with collapsible footwear compartments, showing the backpack with the footwear compartments respectively collapsed and extended.
Figure 12:
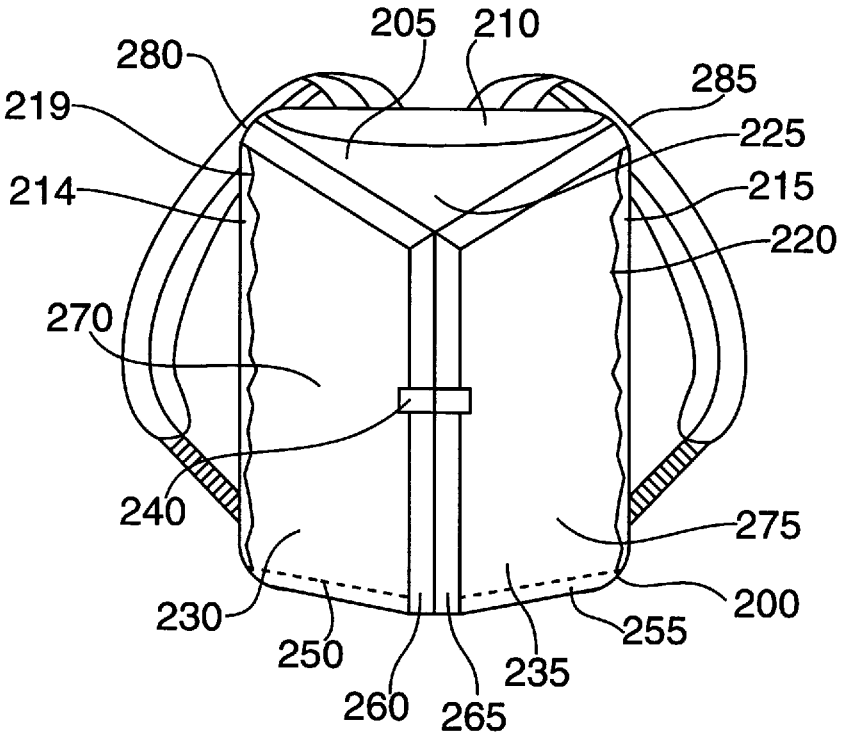

A further alternate embodiment has collapsible footwear compartments, in order to make for a much smaller backpack when footwear is not being carried. This embodiment is shown in FIGS. 11 and 12, which illustrate, respectively, the embodiment with the footwear compartments retracted and extended. In this embodiment, a central compartment 205, which can carry a helmet and other athletic accessories, is attached to a back 200. Central compartment 205 is preferably sewn into place on a back 200 made of fabric. On the right and left sides of central compartment 205, vertically disposed, are attached side pockets 214 and 215. Each side pocket is closable, illustrated here with zippers 219 and 220. Within each side pocket 214, 215 is a collapsible side footwear compartment 230, 235. FIG. 12 shows the backpack with zippers 219, 220 opened and the footwear compartments 230, 235 fully withdrawn. The footwear compartments 230, 235 are joined together in FIG. 12 by closure 240, to form, with back 200, a generally isosceles triangularly shaped internal space 225. In the fully extended depiction (FIG. 11), central compartment 205 forms an interior subcompartment within the internal space 225. The internal space 225 is open at the top and bottom so as to accommodate lengthy articles such as skis, a snowboard, an umbrella, etc., which may be secured by suitable fasteners (not shown), as was the case with fasteners 151, 152 shown in FIG. 10.

Figure 14:
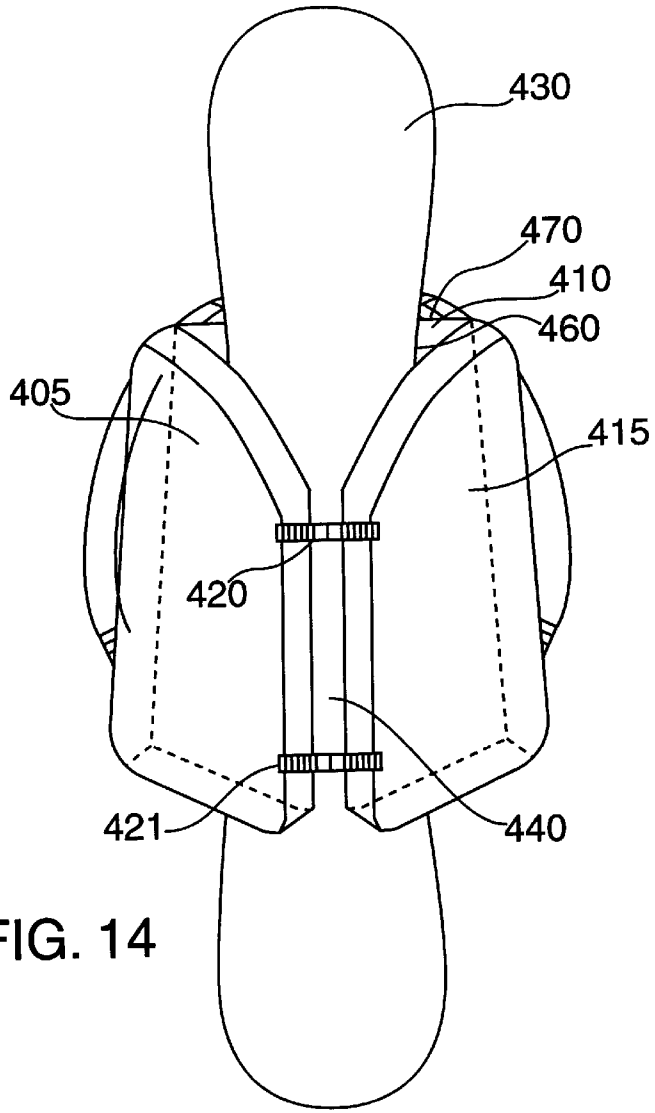
FIGS. 13 and 14 are perspective views, without and with a snowboard being carried, of another embodiment having footwear compartments detachably secured together with closure devices.
Figure 13:
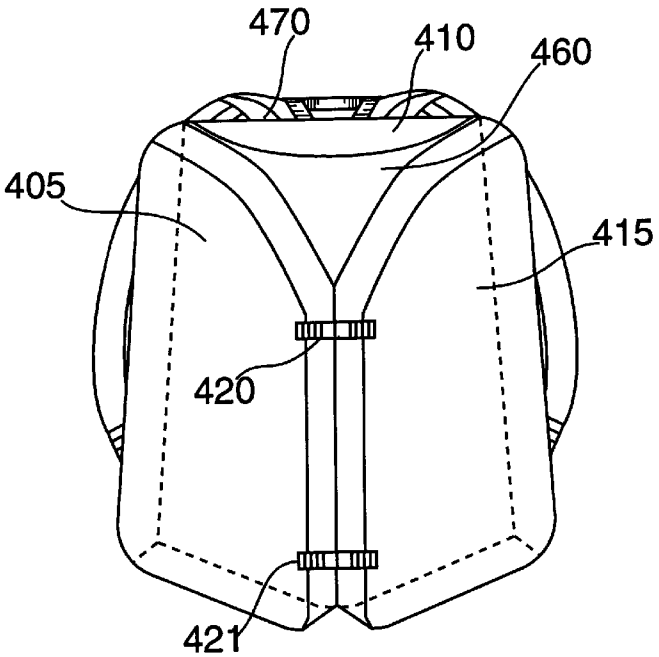

FIGS. 13 and 14 show another embodiment, with and without a snowboard 430 being carried, with footwear compartments detachably secured together with closure devices 420, 421. As shown in FIG. 13, with compartments 405 415 are in opposed footwear compartments 405 415 are in close contact with each other when closure devices 420, 421 are fastened.

FIG. 14 shows the same backpack as in FIG. 13, having a snowboard 430 secured in place. The snowboard 430 can be held in place by internal ties, straps, bungee cords, hooks, etc,. (performing a similar function as fasteners 151, 152 of FIG. 10 (not visible in FIG. 14), or can be held in place by friction or interference with the snowboard binding (not visible). However, FIG. 14 illustrates that in a backpack having such detachable closure means as 420, 421, the opposed footwear compartments do not have to fully meet when the closure means are closed. There may be a gap 440 between the compartments, yet the structure is rigid because of closure force applied through closure means 420, 421 on the backpack and the snowboard or other article being carried. If there is no article being carried, or if it is small in girth, the footwear compartments will contact and rigidity will be provided through the footwear inside of those compartments. Where the footwear compartments 405, 415 are drawn together with a gap (e.g., 440), the interior space 460 defined by the footwear compartments and the back 470 is still generally shaped as an isosceles triangle, but with the front vertex truncated or blunted. (If the footwear compartments are geometrically projected toward each other, an isosceles triangle is still formed.)

Figure 16:
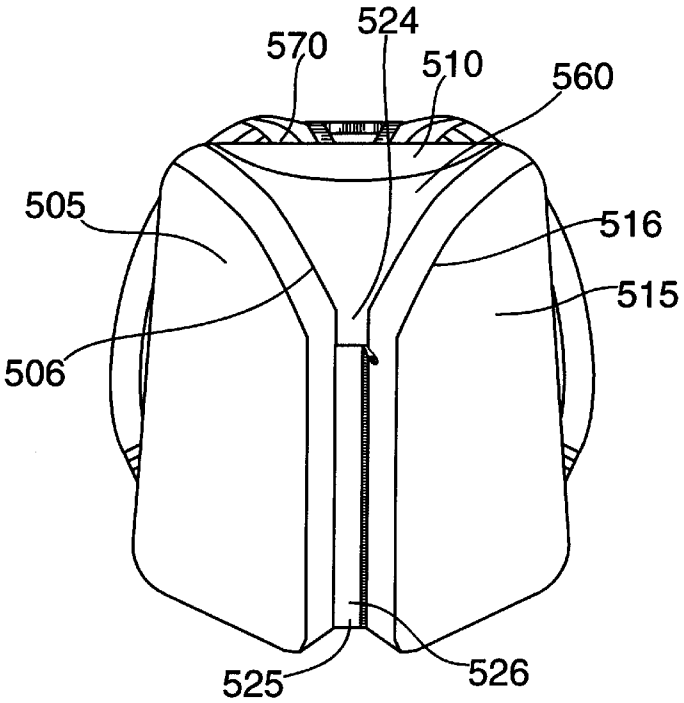
FIGS. 15 and 16 are perspective views of a further alternate embodiment, with and without a snowboard in place, where the footwear compartments are connected to each other with a fabric strip and a zipper closure.
Figure 15:
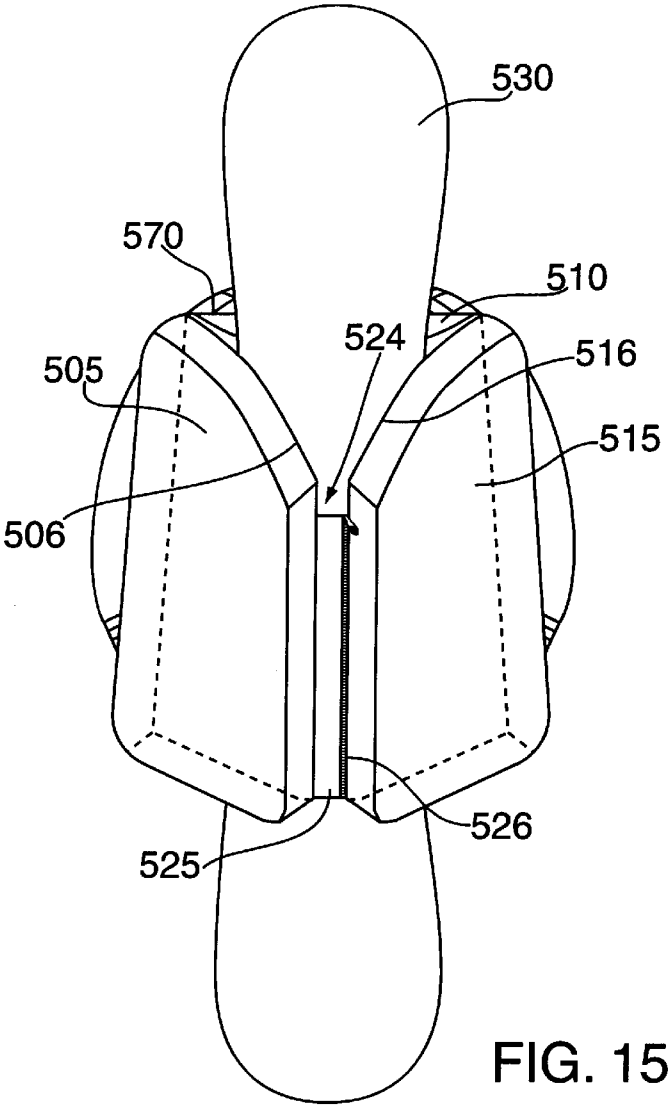

FIGS. 15 and 16 show yet another variation along the lines of FIGS. 13 and 14, with and without a snowboard 530 in place. Here, the footwear compartments are secured to each other with a gap 524, through a fabric strip 525 attached to the edges of inner sidewalls 506, 516, and a zipper closure 526. Again, the interior space 560 defined by the footwear compartments 505, 515 and the back 570 is generally shaped as an isosceles triangle, but with one of the vertices slightly blunted.

Any of the backpacks as shown in FIGS. 13–16 may or may not have side pockets (similar to side pockets 214, 215 in FIGS. 11 and 12) to hold folded-up footwear compartments when not in use. The footwear compartments may have a wide range of shapes, including without limitation any of the generally trapezoidal or polygonal shapes shown in any of the accompanying figures. Also, in any of FIGS. 11 through 15, one or more interior subcompartments, such as in 210, 410 and 510, are optional.

The foregoing is considered an illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

I claim:

1. An improved backpack for carrying a pair of heavy bulky footwear, said backpack having, a front and a back; left and right side compartments, of predetermined size, each said side compartment having side walls, a bottom, a back wall and a front wall, said left and right side compartments being angularly joined together at the front of said backpack to form, with said back, a generally isosceles triangularly shaped interior compartment between the side compartments; and wherein a portion of the front of said backpack is defined by said front walls of said side compartments;

wherein the improvement comprises having openings at the bottom and top of said interior compartment so as to allow to be carried in said backpack articles of length greater than the top-to-bottom dimension of the side walls of said side compartments.

2. An improved backpack in accordance with claim 1, wherein the top and bottom openings occupy less than the total area of said top and bottom, and said interior compartment further comprises a subcompartment occupying a portion of the volume of said interior compartment.

3. A backpack for carrying a pair of heavy bulky footwear comprising a central container on a back; two closable side pockets vertically aligned respectively with the left and right sides of said container; collapsible side compartments each having side walls, a bottom, front and back, and each being joined at its back to the interior of one of said pockets so as to be collapsible into and extractable from said pocket when said pocket is open; closure means on the fronts of said collapsible side compartments, whereby said side compartments, when extracted from said pockets, may be joined together at the front thereof so as to define a generally isosceles triangularly shaped interior space enclosed by said backpack back and said side compartments, which space encloses said central container and is open at the top and bottom thereof so as to allow to be carried in said backpack articles of length greater than the top-to-bottom dimension of the side walls of said side compartments.

4. A backpack for carrying a pair of heavy bulky footwear comprising a central container on a back; two side compartments each having side walls, a bottom, front and back, closure means on the fronts of said side compartments, whereby said side compartments may be detachably joined together at the front thereof, either in contact with each other, or with a gap between said side compartments, so as to define a generally isosceles triangularly shaped interior space enclosed by said backpack back and said side compartments, in which the front vertex is blunted if said side compartments are joined together with a gap, and which space encloses said central container and is open at the top and bottom thereof so as to allow to be carried in said backpack articles of length greater than the top-to-bottom dimension of the side walls of said side compartments.

5. A backpack as described in claim 4, wherein the side compartments are joined together with a gap between them, and said gap is bridged by a fabric strip.

* * * * *